350-332 SR
PTU03 XR 4,390,872

United States Patent [19]
Murakami et al.
[11] 4,390,87
[45] Jun. 28, 19

[54] DOT MATRIX CONDITION DISPLAY DEVICE FOR PHOTOCOPIERS

[76] Inventors: Reiji Murakami, 1438 Nishiterao, Kanagawa-ku, Yokohama-shi; Shunichi Nakajima, 408 Kishine-cho, Kohoku-ku, Yokohama-shi, both of Japan

[21] Appl. No.: 257,620

[22] Filed: Apr. 27, 1981

[30] Foreign Application Priority Data

Apr. 30, 1980 [JP] Japan ..... 55/58346

[51] Int. Cl.[3] ..... G08B 21/00

[52] U.S. Cl. ..... 340/679; 340/691; 340/715; 340/784

[58] Field of Search ..... 340/679, 674, 691, 521, 340/715, 784; 355/14 C

[56] References Cited

U.S. PATENT DOCUMENTS 4,062,061 12/1977 Batchelor et al. ..... 355/14
4,287,504 9/1981 Simon et al. ..... 340/
4,317,115 2/1982 Kawakami et al. ..... 340/

*Primary Examiner*—Glen R. Swann, III

[57] ABSTRACT

A display device for a photocopier of the invention h a display unit comprising a dot matrix type liquid cr tal panel and an ROM which stores in advance patte of symbol marks corresponding to various troubl When a trouble arises, the pattern corresponding to t trouble is read out from the ROM by the operation the control unit and is displayed at the display unit the display control unit.

7 Claims, 24 Drawing Figures

DOT MATRIX CONDITION DISPLAY DEVICE FOR PHOTOCOPIERS

BACKGROUND OF THE INVENTION

The present invention relates to a display device for a photocopier.

A photocopier is generally equipped with various dislay devices for informing the user of various troubles occuring during use. Examples of conventional display devices of the type described above are shown in FIGS. 1 and 2. In the display device shown in FIG. 1, holes 4 are formed in the vicinities of symbol marks printed on a symbol panel 2. Display is performed by lighting lamps 6 respectively arranged below these holes 4. Each of the symbol marks has its own meaning. For example, the symbol "ADD PAPER" associated with reference numeral 8 means that paper must be supplied, and that "READY" of reference numeral 10 means copying may be started at any time. The display device shown in FIG. 2 employs a screen 12 with symbol marks and display phrases corresponding to these symbol marks in place of the symbol panel 2. This device is so constructed that the symbol marks and the display phrases are lit by lighting lamps 14 arranged below the screen 12.

However, the display device for a photocopier of such a construction had drawbacks. For example, the area occupied by the display device becomes larger as the kinds of displays become greater. Although this does not pose a serious problem for a large photocopier, this limits the number of kinds of displays which may be provided by a small photocopier, precluding the display of all the functions.

SUMMARY OF THE INVENTION

The present invention has been made in consideration of this and has for its object to provide a display device so that even if a photocopier is small, a large quantity of information may be provided to the user. Also, the construction of the display devices is simple, and the display is of low cost.

In order to achieve the above and other objects, the present invention provides a display device for a photocopier which detects the various troubles of the photocopier by a detector and displays information about these troubles. A display is provided for displaying symbol marks corresponding to the various troubles of the photocopier. A pattern generator stores the symbol marks. A control device receives at least one detection signal from a detector and outputs a control signal to read out a pattern corresponding to the detection signal from the pattern generating means. A display driver receives the output signal from the control device and drives the display to display a corresponding symbol mark.

According to the display device for a photocopier of the present invention, various types of mark displays are realized by simply storing various symbol marks in a pattern generating means, thereby allowing the area occupied by the display unit to be made smaller. Thus, a display unit which is extremely easy for the user to observe may be provided. Further, the number and kinds of symbol marks to be stored in the pattern generator may be changed. A display device which may be generally used for all models of photocopiers may thus be provided.

Other objects and features of the present invent will be apparent from the following description take connection with the accompanying drawings.

BRIEF DESCRIPTION OF THE DRAWING

FIG. 11A shows the symbol display calling for sup of more paper ("ADD PAPER"), FIG. 11B shows symbol display for a jammed condition ("PAPI JAM"), and FIG. 11C shows the symbol display for ready condition of the photocopier ("READY");

FIGS. 15A and 15B are views illustrating the oper ing principles of the pattern generator shown in FI 12, wherein FIG. 15A shows the symbol display and t phrase display for supplying more paper, and FIG. 1 shows the symbol display and the phrase display fo paper jam;

FIGS. 18A through 18D are views illustrating t operating principles of the pattern display unit shown FIG. 17, wherein FIG. 18A shows the phrase displ and the symbol display for "PAPER JAM, " FIG. 1 shows the phrase display for "ADD PAPER," FI 18C shows the phrase display for "WAIT," and FI 18D shows the phrase display for the "READY" con tion of the photocopier, respectively.

DETAILED DESCRIPTION OF THE PREFERRED EMBODIMENTS

Figure 1:
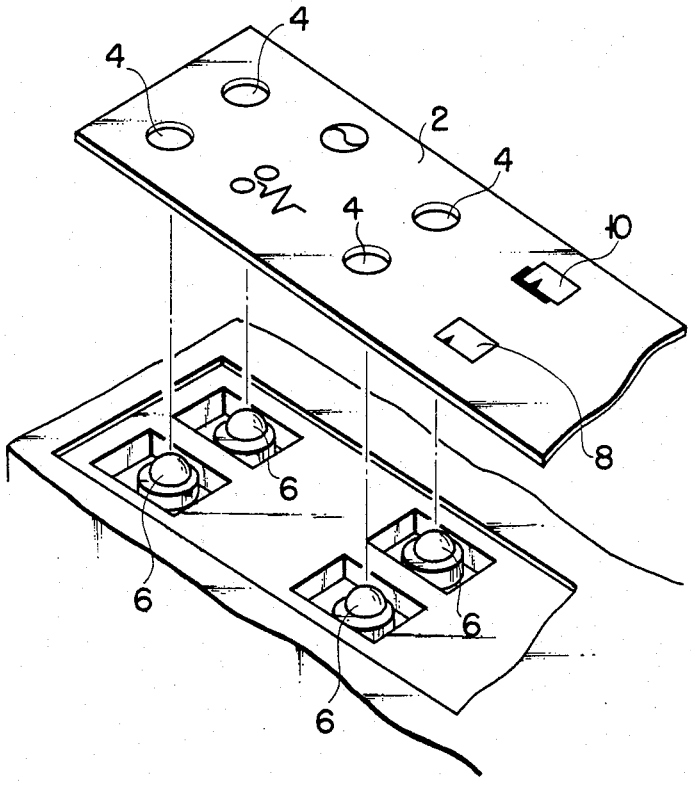
FIG. 1 (PRIOR ART)
FIGS. 1 and 2 are perspective views of conventic display devices for a photocopier.
Figure 2:
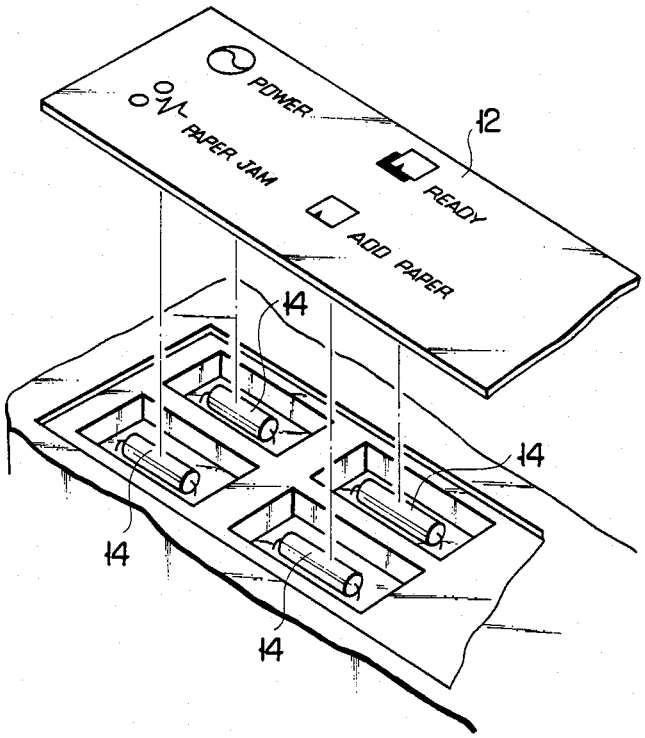
FIG. 2 (PRIOR ART)
Figure 3:
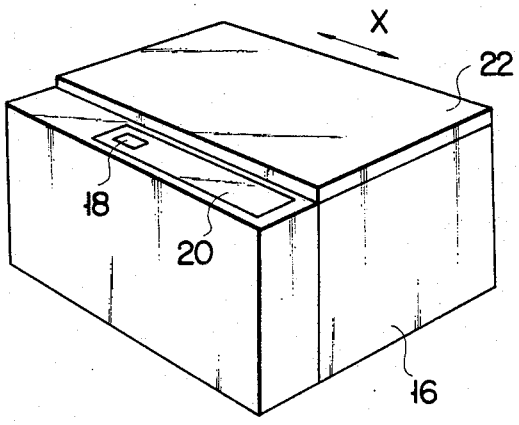
FIG. 3 is a perspective view of an overall phc copier incorporating one embodiment of the pres invention.
Figure 4:
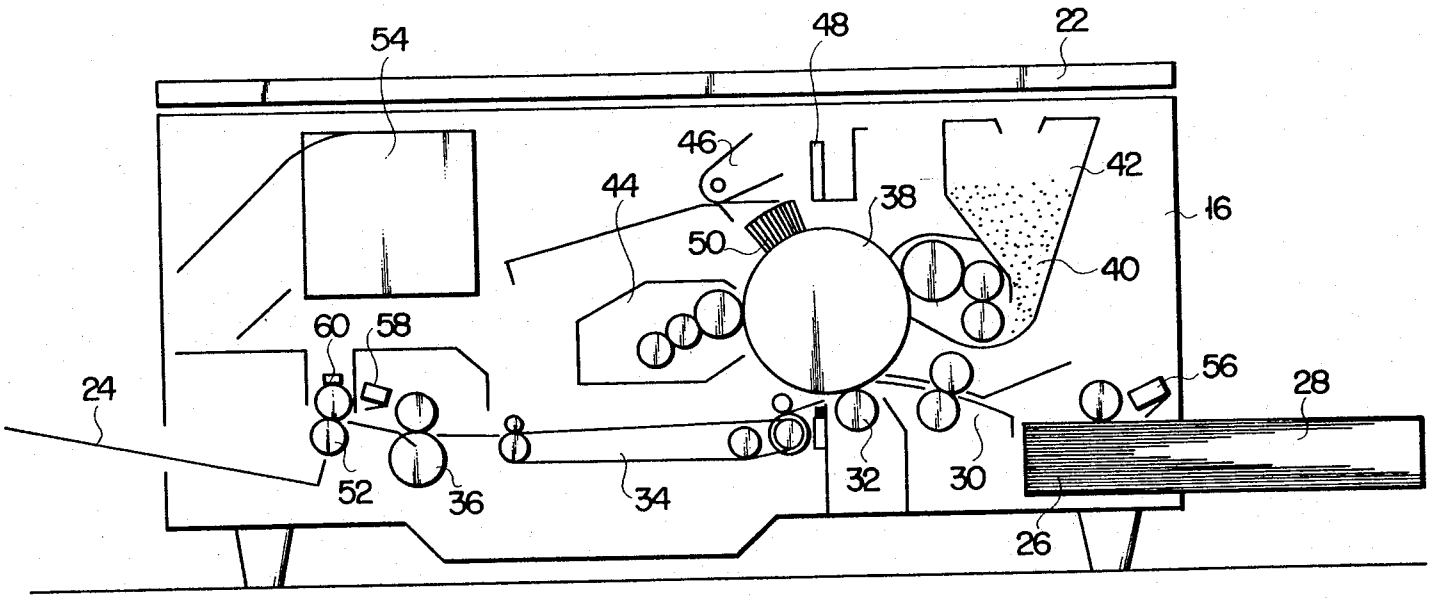
FIG. 4 is a schematic sectional view of the dev shown in FIG. 3.

FIG. 3 is a perspective view of a photocopier to which a display device of the present invention is to be applied. FIG. 4 is a schematic sectional view of the photocopier shown in FIG. 3.

Referring to FIG. 3, a control panel 20 having a display unit 18 is disposed at one upper side edge of a photocopier 16. A manuscript table 22 of the photocopier 16 reciprocates in the direction shown by arrow X as required. A detachable tray 24 is mounted at the left side of the photocopier 16 as shown in FIG. 4, and a cassette 28 holding paper copying sheets 26 is mounted to the right side of the photocopier in the figure.

Inside this photocopier 16 are incorporated a paper feeding mechanism 30 for feeding the paper copying sheets 26 in the cassette 28, a copying mechanism 32, a carrying mechanism 34, a fixing mechanism 36, a photosensitive body 38, a developer 42 containing toner 40, a cleaning mechanism 44 for the photosensitive body 38, an illumination system 46, an optical fiber lens 48, a charger 50, carrying rollers 52, and a motor 54 for synchronously moving the manuscript table 22 and rotating the photosensitive body 38. A paper-absence detector 56 (e.g., a microswitch) is disposed at the upper middle part of the paper feeding cassette 28. A paper jam detector 58 (e.g., a microswitch) is disposed at the left side of the fixing mechanism 36. A temperature detector 60 (e.g., thermistor) is arranged at the upper part of the rollers 52 for exhaustion located in the vicinity of the edge of the tray 24. In this type of device, the manuscript placed on the manuscript table 22 is illuminated by the illumination system 46, and an image of it is formed on the surface of the photosensitive body 38 through the optical fiber lens 48. Thereafter, the paper copying sheets 26 inside the paper feeding cassette 28 are fed one by one by the paper feeding mechanism 30 and are guided below the photosensitive body 38. A photosensitive image developed by toner 40 inside the developer 42 is copied on the paper copying sheet 26 by the copying mechanism 32. The sheet 26 is guided to the fixing mechanism 36 through the carrying mechanism 34 for fixing and is exhausted to the tray 24. After the copying operation, the photosensitive body 38 is cleaned by the cleaning mechanism 44 which is positioned by the charger 50.

Figure 5:
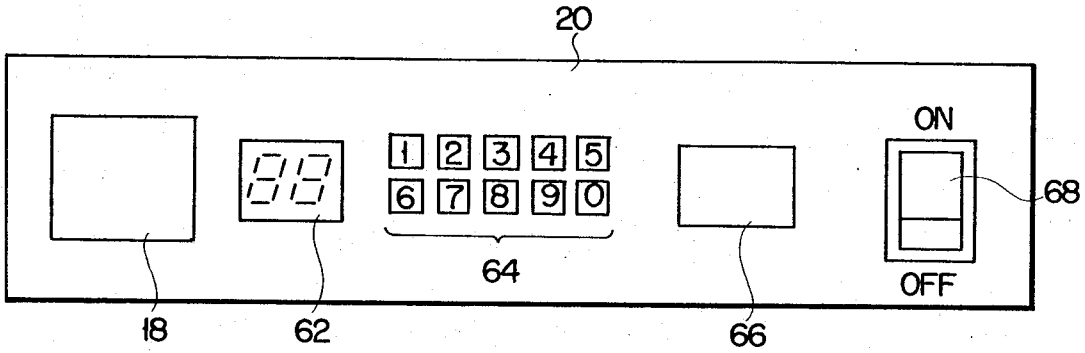
FIG. 5 is a plan view illustrating one embodimen the control panel of the display device for a phc copier according to the present invention.
Figure 6:
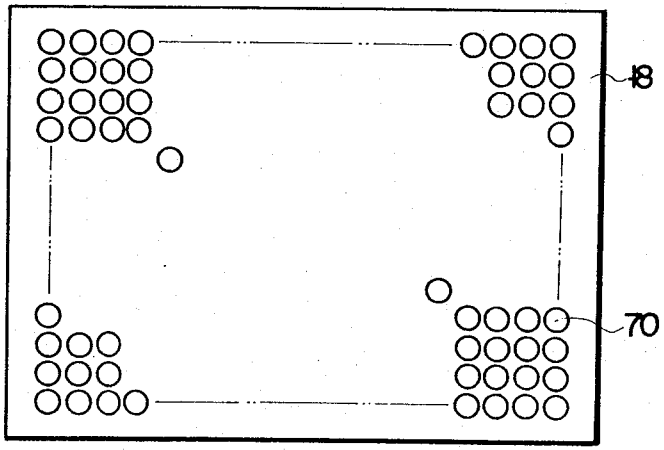
FIG. 6 is a schematic view illustrating one embc ment of the pattern display unit of the display device a photocopier according to the present invention.

The control panel 20 has, as shown in FIG. 5, a display unit 18, a counter display unit 62, ten keys 64, a copy button 66, and a power source switch 68. The display unit 18, more particularly, comprises a liquid crystal panel 70 of the dot matrix type, as shown in FIG. 6.

Figure 7:
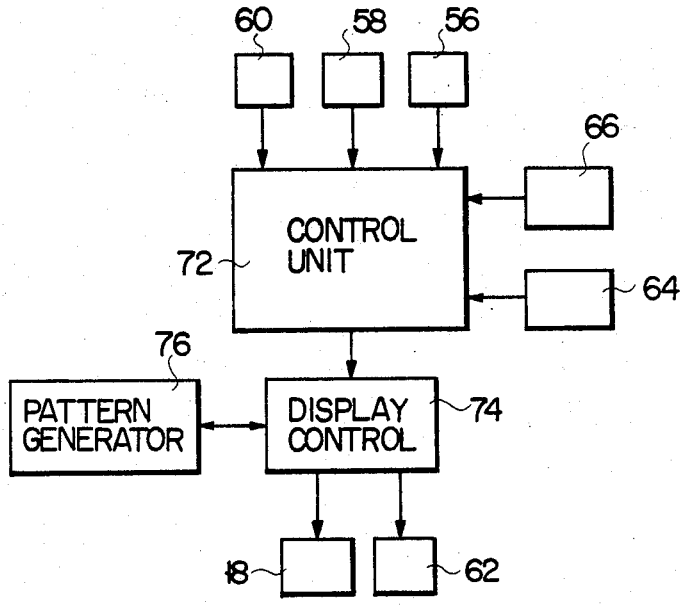
FIG. 7 is a block diagram illustrating one embc ment of the control unit for the display device of present invention.
Figure 9:
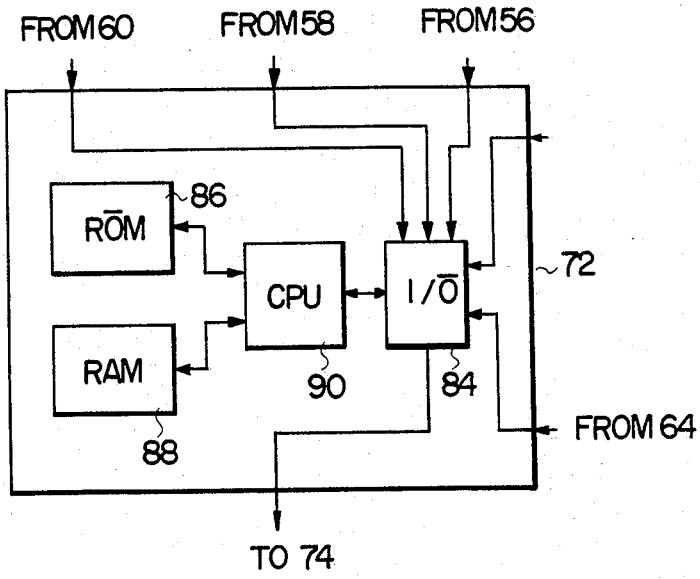
FIG. 9 is a detailed block diagram of the control u shown in FIG. 8.
Figure 10:
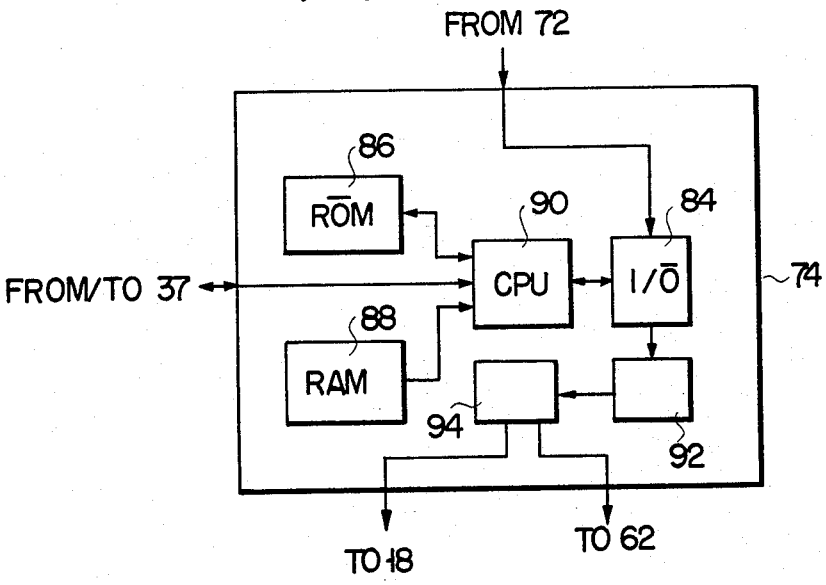
FIG. 10 is a detailed block diagram of the disp control unit shown in FIG. 8.

An embodiment of the control system for this display unit 18 will be described with reference to FIG. 7. Referring to this figure, reference numeral 72 denotes a control unit and comprises, for example, a one-chip microcomputer incorporating an input/output port (I/O port) 84, a read-only memory (ROM) 86, a random-access memory (RAM) 88, and a central processing unit (CPU) 90, as shown in FIG. 9. To this control unit are applied the output signals of the paper-absence detector 56, the paper jam detector 58 and the temperature detector 60, as well as the output signals of the ten keys 64 and the copy button 66. This control unit is thus constructed to process these signals and to output predetermined control signals. Reference numeral 74 denotes a display control unit which drives, according to the control signal from the control unit 72, the display unit 18 and the counter display unit 62. This display control unit 74 comprises, for example, a one-chip microcomputer incorporating the I/O port 84, the ROM 86, the RAM 88, the CPU 90, a decoder 92, and a liquid crystal driver 94, as shown in FIG. 10.

Figure 8:
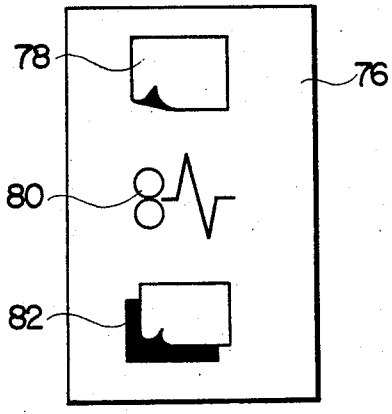
FIG. 8 is a view illustrating the stored contents of pattern generator used in the control unit shown FIG. 7.

Reference numeral 76 denotes a pattern generator and comprises, for example, the ROM 86 which stores a symbol mark 78 (see FIG. 8) representing "ADD PAPER," a symbol mark 80 representing "PAPER JAM," and a symbol mark 82 representing "READY." The contents of the pattern generator 76 are read out as binary code signals by address selection signals from the display control unit 74, decoded by the display control unit 74, and are reproduced by lighting the predetermined liquid crystal cell in the display unit 18. Preferably, many kinds of symbol marks are prepared as required and the detectors are disposed in correspondence therewith.

The mode of operation of the device of the construction as described above will be described with reference to FIGS. 11A through 11C.

Figure 11B:
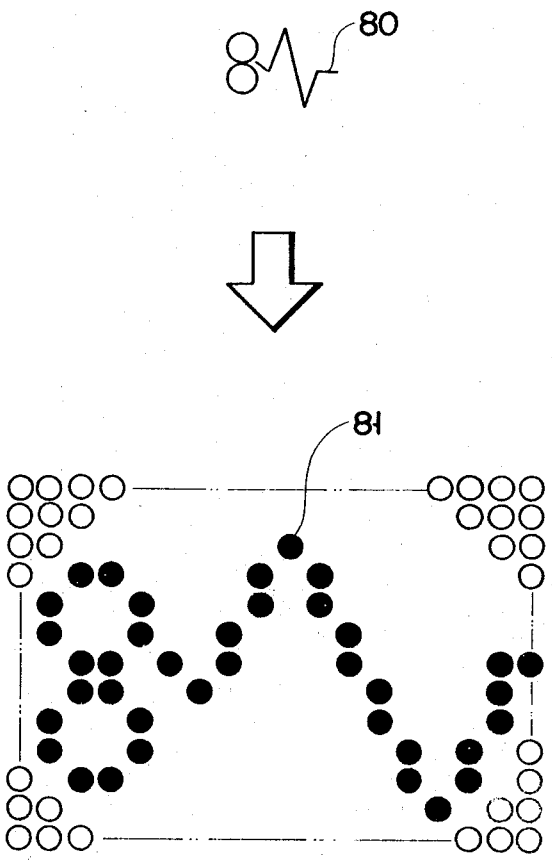
FIGS. 11A through 11C are views illustrating operating principles of the display device for a pho copier according to the present invention, wher
Figure 11A:
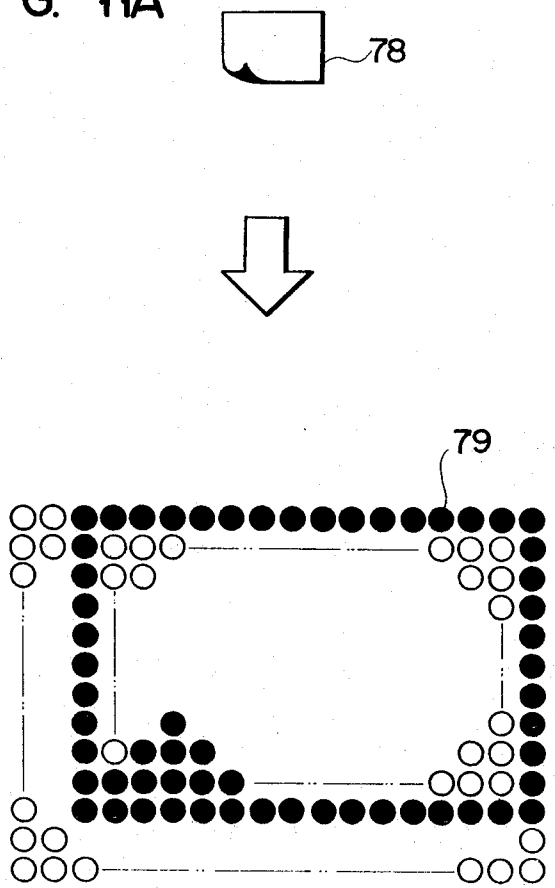

When the paper copying sheets 26 in the cassette 28 are used up during the copying operation, the paper-absence detector 56 operates, and an output signal from this paper-absence detector 56 is applied to the control unit 72. The control unit 72 process the output signal from the paper-absence detector 56 and supplies an "ADD PAPER" display signal to the display control unit 74. The display control unit 74 outputs a signal for selecting the "ADD PAPER" symbol mark 78, reads out this mark 78, and supplies to the display unit 18 a display signal decoded by the read signal. Thus, the symbol mark 79 equivalent to the mark 78 stored in the pattern generator 76 is displayed at the display unit 18. The user is thus capable of recognizing that more paper copying sheets must be added and responding to this need (FIG. 11A).

When the copied paper sheet is jammed in the vicinity of the exhausting section, the paper jam detector 58 interposed between the carrying rollers 52 and the fixing mechanism 36 operates and its output signal is supplied to the control unit 72. A control signal is thus output from the control unit 72 to actuate the display control unit 74. Then, the paper jam mark 80 in the pattern generator 76 is selectively read out, and a drive signal is supplied to the display unit 18. The symbol mark 81 representing "PAPER JAM" is thus displayed. When the user sees this, an inspection can be performed and the jammed paper can be removed (FIG. 11B).

Figure 11C:
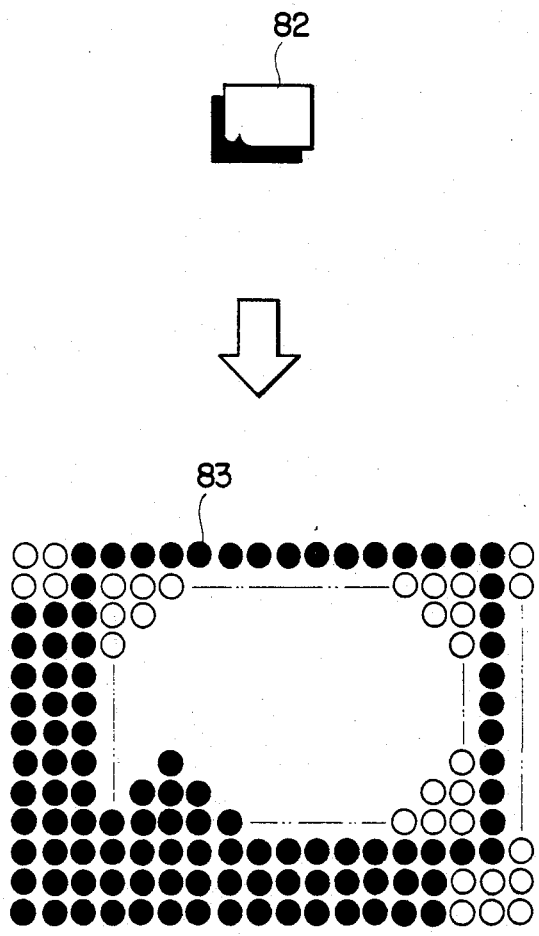

When further copying operation is possible, the mark 82 in the pattern generator 76 is selected. Then, a symbol 83 representing "READY" is displayed at the display unit 18. When the user sees this, he can depress the copy button (FIG. 11C).

In addition to this, various other symbol marks stored in the pattern generator 76 may be displayed as the case may require. It is preferable that the meanings of the symbol marks be clarified in the instruction manual.

Figure 12:
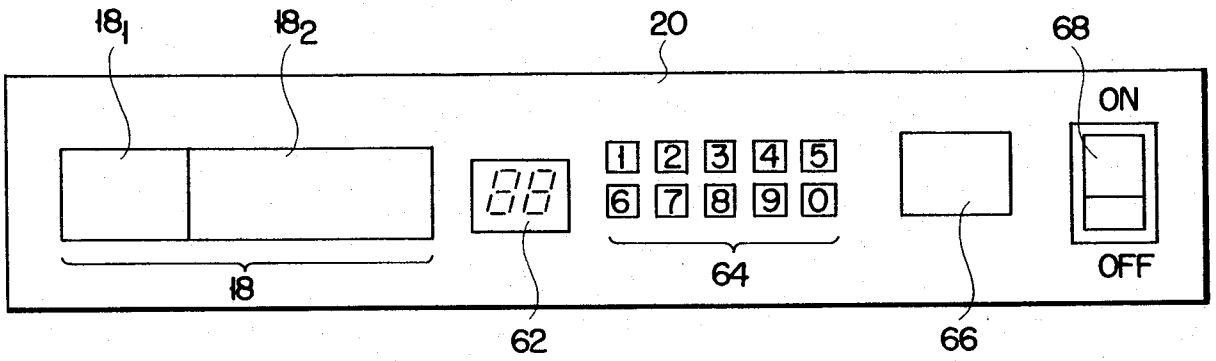
FIG. 12 is a plan view illustrating another embo ment of the control panel of the display device acco ing to the present invention.
Figure 13:
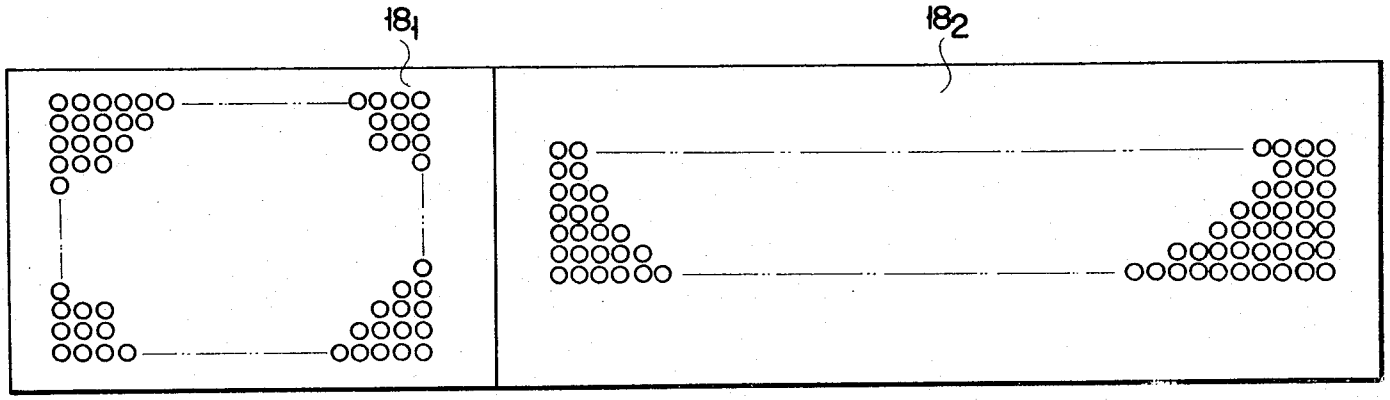
FIG. 13 is a schematic view illustrating one embo ment of the pattern generator.
Figure 14:
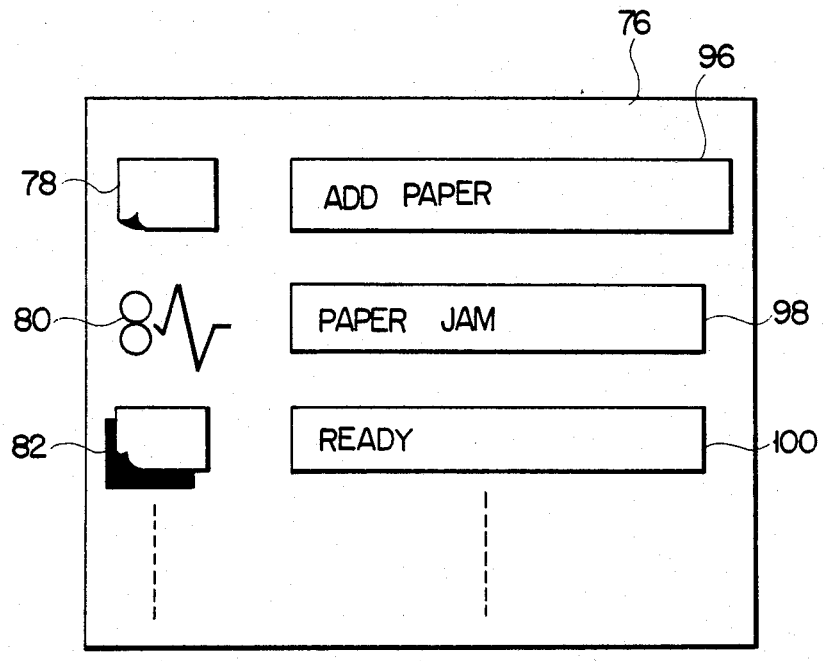
FIG. 14 is a view illustrating an example of the stor contents of the pattern generator used in the embo ment shown in FIG. 12.

FIG. 12 shows another embodiment of the display device of the present invention. This embodiment represents a case in which the display unit 18 arranged in the control panel 20 is transversely divided into two regions $18_1$ and $18_2$. This display unit 18 comprises, for example a symbol mark display unit $18_1$ and a phrase display unit $18_2$ representing the meanings of these symbol marks as shown in FIG. 13. These units comprise a liquid crysta matrix panel. The liquid crystal cells of these display units $18_1$ and $18_2$ are driven and controlled by the two kinds of signals (synchronized with each other) output from the display control unit 74. Although the construction of the control system is substantially the same as that of the embodiment described above, the contents stored in the pattern generator 76 differ slightly from those of the embodiment described above. For Example, in addition to the symbol marks 78, 80 and 82, display phrases 96, 98 and 100 "ADD PAPER," "PAPER JAM," and "READY," are also stored as shown in FIG. 14. The various stored contents are selected based on a command signal from the display control unit 74 and are displayed at the display units $18_1$ and $18_2$ to be associated with each other.

Figure 15A:
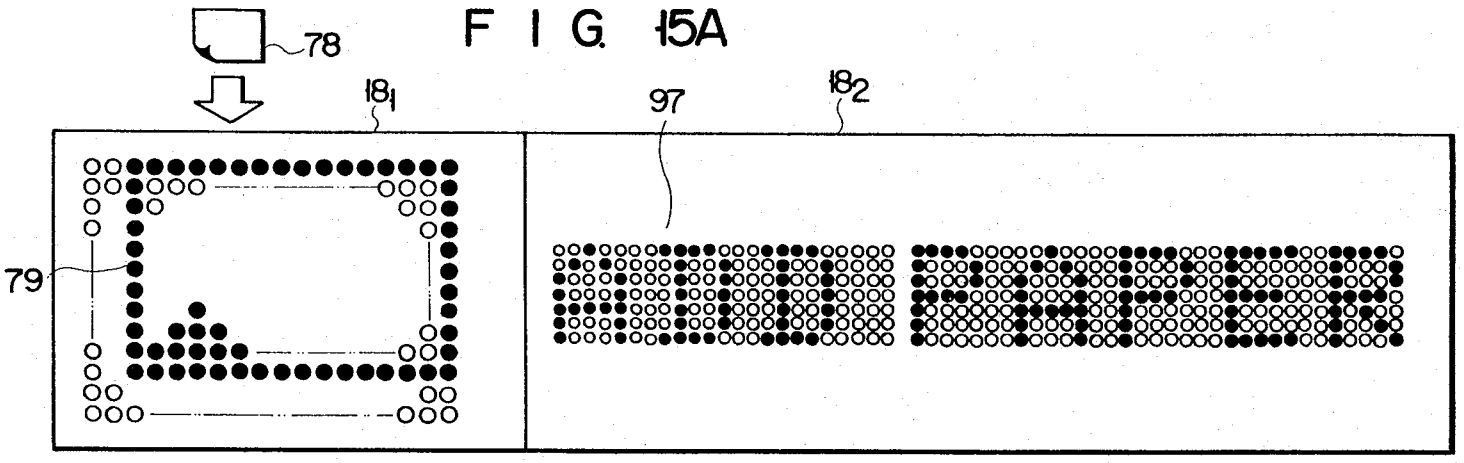

The mode of operation of the embodiment shown in FIG. 12 will be described with reference to FIGS. 15A and 15B.

When an output is supplied from the paper-absence detector 56, the symbol marks 78 and 96 are sequentially selected according to the operations of the control unit 72 and the display control unit 74. The symbol mark 79 is displayed at the display unit $18_1$ and a display phrase 97, "ADD PAPER" is simultaneously displayed at the display unit $18_2$ (FIG. 15A).

Figure 15B:
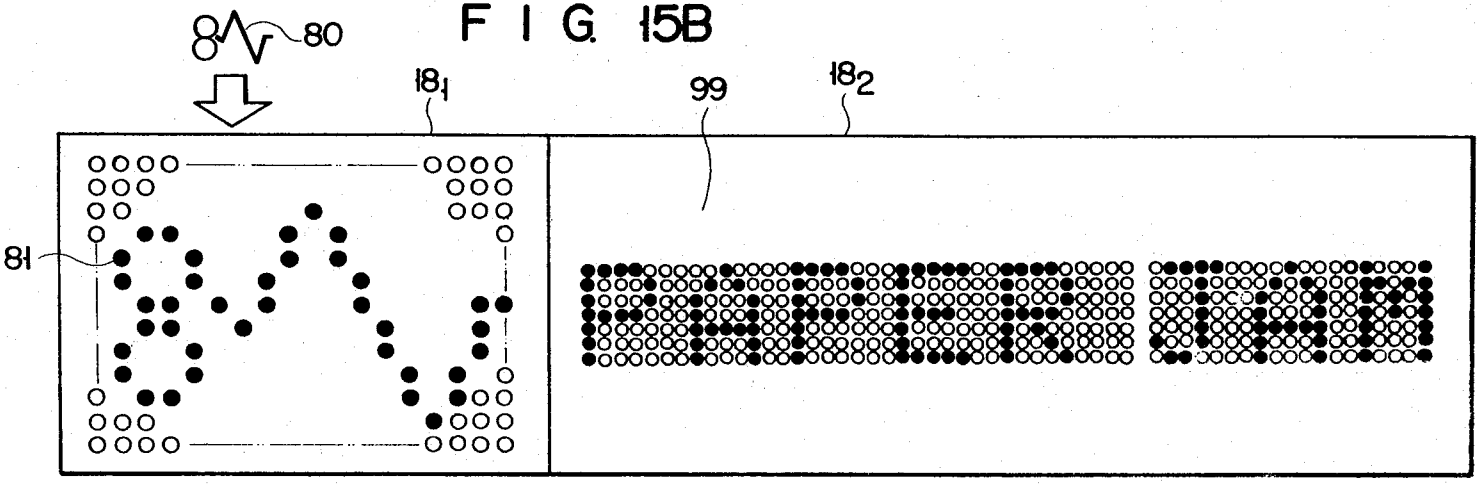

In the case of a paper jam, a mark 81 and a display phrase 99 "PAPER JAM" are simultaneously displayed at the display unit 18 (FIG. 15B).

In this embodiment, the symbol mark as well as the display phrase representing its meaning are simultaneously displayed. Due to this, in addition to the advantages obtained in the embodiment shown in FIG. 7, this embodiment presents further advantages in that the user may directly recognize the nature of the trouble and may take fast measures.

Figure 16:
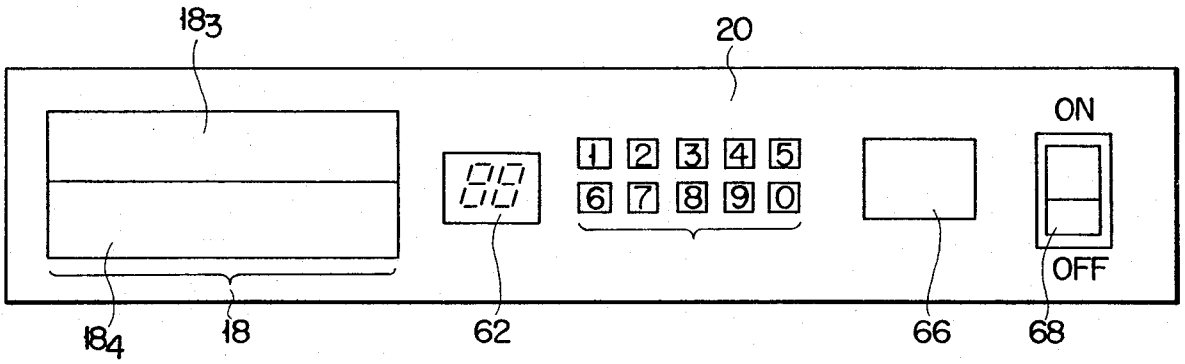
FIG. 16 is a plan view illustrating still another e bodiment of the control panel of the display devi according to the present invention.
Figure 17:
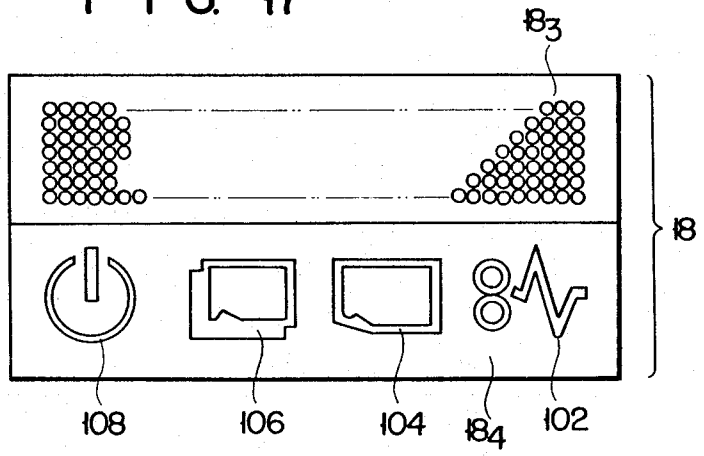
FIG. 17 is a schematic view illustrating an embo ment of the pattern display unit according to the e bodiment shown in FIG. 16.

FIG. 16 shows a still further embodiment of the display device for a photocopier according to the present invention. According to this embodiment, the display unit 18 arranged in the control panel 20 is divided into two vertically arranged regions $18_3$ and $18_4$. In this display unit 18, the upper region $18_3$ comprises a liquid crystal matrix panel for a phrase display unit as shown in FIG. 17, and the particular symbol marks 102, 104, 106 and 108 are displayed at the lower region $18_4$ making up a symbol mark display unit.

To the display control unit are separately supplied a signal for driving the liquid matrix panel and a signal for driving the liquid crystal for a particular symbol mark.

Accordingly, it is possible to simultaneously drive both the regions $18_3$ and $18_4$ or to drive either of these separately. Since the construction of other parts is the same as that of the embodiments described above, the description thereof will be omitted.

Figure 18A:
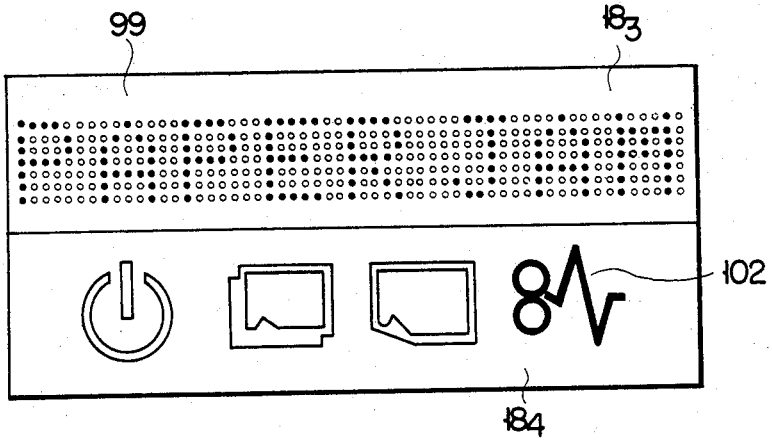
Figure 18B:
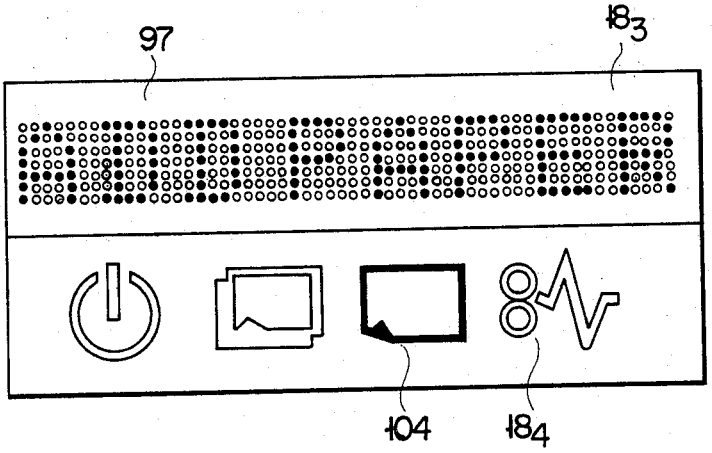

The operation of the device of this embodiment will now be described with reference to FIGS. 18A through 18D. When the paper jam detector 58 operates and a command signal is output from the control unit 72, respective drive signals are output from the display control unit 74. The phrase 99, "PAPER JAM" is displayed at the phrase display unit $18_3$ so that the symbol mark 102 at the symbol mark display unit $18_4$ may be recognized (FIG. 19A). When there is no more paper, by the operation described hereinabove, the display phrase 97, "ADD PAPER" is displayed at the phrase display unit $18_3$ so that the mark 104 at the symbol mark display unit $18_4$ may be recognized (FIG. 18B).

Figure 18C:
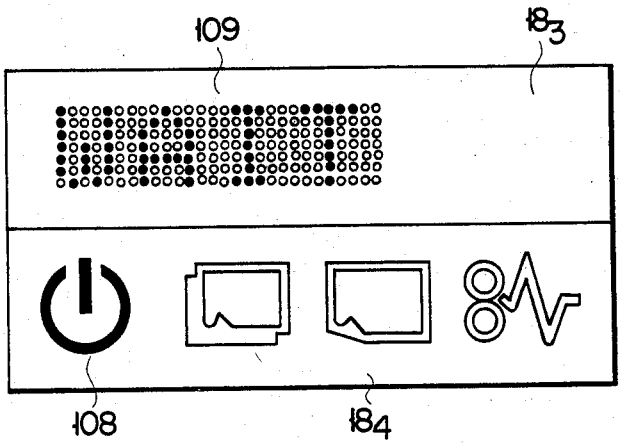
Figure 18D:
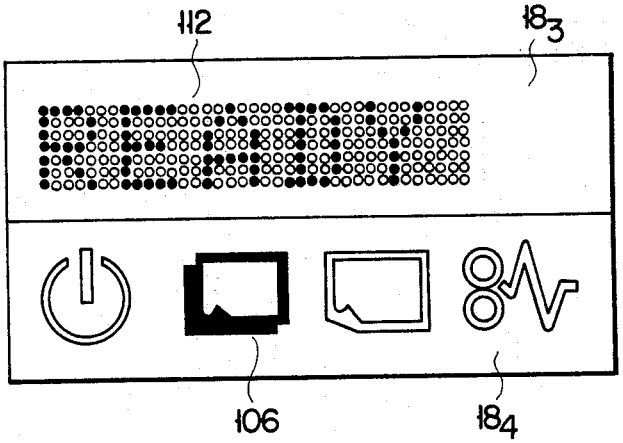

During the warm-up operation, a display phrase 109, "WAIT," is displayed at the phrase display unit $18_3$ so that the mark 108 at the symbol mark display unit 1 may be recognized (FIG. 18C).

When the photocopier is ready to start copying, tl display phrase 112, "READY," is displayed at tl phrase display unit $18_3$ so that the mark 106 at the syn bol mark display unit $18_4$ may be recognized (FI( 18D).

In a similar manner, various other pairs of displa phrases and symbol marks are simultaneously displaye at the upper and lower regions of the display unit a cording to the various troubles. When a trouble occu which does not correspond to any of the display phras for symbol marks 102, 104, 106 and 108, the upper r gion of the display unit 18 is selectively driven so th the display phrase alone is displayed.

According to the above embodiment, it is possible display the kinds of troubles which most frequentl occur with both display phrases and symbol marks both the upper and lower regions, and to display tl kind of troubles which occur less frequently with di play phrases at the upper region alone. Accordingly, large quantity of information may be provided to tl user by simply increasing the stored contents of tl pattern generator.

Although the display phrases were all in English the above embodiments, it is possible to simultaneousl store phrases in French, German, Chinese and so on allow selective display according to the market for tl products. With this construction, there is no need change the printing of the display unit of the contr panel according to the language of the market for tl product as has been the case with conventional displa devices.

Although a liquid crystal display unit was used in tl above embodiments, it is possible to use an LED (ligh emitting diode) or a photoelectric conversion elemen or the like.

It is also possible to dispose a plurality of detectors the carrying path of the paper copying sheet within tl photocopier and to store display phrases representin the positions of these detectors, so that the kinds troubles as well as the positions may be displayed.

What we claim is:

1. A display device for a photocopier for detectin various troubles of the photocopier by a detector an for displaying these troubles, comprising:

(a) display means for simultaneously displaying bot symbol marks corresponding to various troubles said photocopier and display phrases representin the meanings of said symbol marks;

(b) pattern generating means for electronically sto ing pattern signals representing said symbol mar and said display phrases;

(c) control means for receiving at least one detectio signal from said detector and for outputting a co trol signal to read out from said pattern generatin means said pattern signals representing said symb mark and said display phrase corresponding to sai detection signal; and (d) display driving means for receiving said patter signals and for driving said display means in acco dance with said pattern signals read out from sai pattern generating means to display said corr sponding symbol mark and said display phrase.

2. A display device for a photocopier for detectin various troubles of the photocopier by a detector an for displaying these troubles, comprising:

(a) display means, for displaying fixed symbol marks corresponding to various troubles of said photocopier and means for simultaneously displaying display phrases representing the meanings of said symbol marks in close proximity to said symbol marks;

(b) pattern generating means for electronically storing pattern signals representing said display phrases;

(c) control means for receiving at least one detection signal from said detector and for outputting a control signal to read out from said pattern generating means said pattern signal representing said display phrase corresponding to said detection signal; and (d) display driving means for receiving said pattern signal and for driving said display means in accordance with said pattern signal read out from said pattern generating means to light up said corresponding fixed symbol mark as well as said display phrase.

3. A display device for a photocopier according to claim 1 or 2, wherein said display means comprises a liquid crystal panel of dot matrix type.

4. A display device for a photocopier according to claim 1 or 2, further comprising a counter display unit for displaying the number of copies made.

5. A display device for a photocopier according to claim 1 or 2, wherein said control means and said display drive means comprise a microcomputer.

6. A display device for a photocopier according to claim 1 or 2, wherein said display unit further displays phrases representing locations of troubles.

7. A display device for a photocopier according to claim 1 or 2, wherein said pattern generating means comprises a read-only memory.

* * * * *

U 2 079
4390872
C. BONET / BOX 711
ACCESSION #7-17
CRYSTAL SQUARE 4 x 105-G07
2 STAPLES AT BOTTOM
ZIP: BOX 711
02130375
ANN PHILLIPS X026
TL
02/13

UNITED STATES PATENT AND TRADEMARK OFFICE

CERTIFICATE OF CORRECTION

PATENT NO. : 4,390,872

DATED : June 28, 1983

INVENTOR(S) : Reiji Murakami, et al

It is certified that error appears in the above-identified patent and that said Letters Patent is hereby corrected as shown below:

On the title page insert:

-- [73] Assignee: TOKYO SHIBAURA DENKI KABUSHIKI KAISHA, Kawasaki, Japan --.

Signed and Sealed this

Fourteenth Day of October, 1986

[SEAL]

*Attest:*

DONALD J. QUIGG

*Attesting Officer*

*Commissioner of Patents and Trademarks*